United States Patent [19]

Nakao et al.

[11] 4,402,299

[45] Sep. 6, 1983

[54] IGNITION COIL ENERGIZING CIRCUIT

[75] Inventors: Satoshi Nakao, Tokyo; Yasuo Taguchi; Takashi Higuchi, both of Yokohama, all of Japan

[73] Assignee: Tokyo Shibaura Denki Kabushiki Kaisha, Kawasaki, Japan

[21] Appl. No.: 309,054

[22] Filed: Oct. 6, 1981

[30] Foreign Application Priority Data

Oct. 9, 1980 [JP] Japan ..... 55-141744

[51] Int. Cl.[3] ..... F02P 1/00

[52] U.S. Cl. ..... 123/632; 123/644

[58] Field of Search ..... 123/644, 632

[56] References Cited

U.S. PATENT DOCUMENTS

| | | | |
|---|---|---|---|
| 4,008,698 | 2/1977 | Gartner | 123/644 |
| 4,167,170 | 9/1979 | Sohner . | |
| 4,245,610 | 1/1981 | Sugiura . | |
| 4,248,200 | 2/1981 | Sugiura . | |
| 4,285,323 | 8/1981 | Sugiura . | |

FOREIGN PATENT DOCUMENTS

| | | | |
|---|---|---|---|
| 55-46030 | 3/1980 | Japan | 123/644 |

*Primary Examiner*—Ronald B. Cox

*Attorney, Agent, or Firm*—Finnegan, Henderson, Farabow, Garrett and Dunner

[57] ABSTRACT

An ignition coil energizing circuit is provided which has a signal generator for generating an output signal having a frequency corresponding to an engine rotational speed, a switching circuit connected to an ignition coil, a current detector for detecting a current flowing through the ignition coil, a duty control for supplying to the switching circuit a control signal having a duty cycle corresponding to a duty cycle of an output signal from the signal generator and controlling a conduction state of the switching circuit, and a current control circuit for controlling the switching circuit in response to an output signal generated from the current detector and maintaining a current flowing through the current detector at a predetermined value. The ignition coil energizing circuit also has a timer for generating an output signal when the switching circuit is detected to be on over a predetermined period of time and a current supply circuit for supplying a gradually increasing current to the current detector in response to an output signal of the timer.

2 Claims, 19 Drawing Figures

VREF1

IGNITION COIL ENERGIZING CIRCUIT

BACKGROUND OF THE INVENTION

The present invention relates to an ignition coil energizing circuit for use in the internal combustion engine.

FIG. 1 is a circuit diagram showing the conventional ignition device employed in the internal combustion engine. This prior art ignition device includes a signal generator 2 for generating a rotation speed signal which represents the rotation speed of a shaft picked up by a pickup coil of magnet induction type, for example, an ignition timing detector 4 for generating an output pulse representing the ignition timing responsive to an output signal applied from the signal generator 2, a series circuit of a primary winding 6-1 of an ignition coil 6 connected between a power source $V_D$ and the ground, a transistor switching circuit 8 and a resistor 10, and a secondary winding 6-2 of ignition coil 6 and an ignition plug 12 connected in series between the power source $V_D$ and ground. The prior art ignition device further includes a duty cycle control circuit 14 for generating a duty cycle signal responsive to an output signal applied from the ignition timing detector 4. The duty cycle signal serves to determine the period for which the switching circuit 8 is kept ON or OFF, and a circuit 16 for driving the switching circuit 8 responsive to an output signal applied from the duty cycle control circuit 14. A series circuit of resistors 18 and 20 is further connected in parallel with the resistor 10, and an input terminal of a constant current control circuit 22 is connected to the junction between these resistors 18 and 20. This constant current control circuits detects that the current flowing to the primary winding 6-1 of the ignition coil 6 reaches a predetermined value, controls a driver circuit 16 responsive to this current to keep constant the current flowing to the switching circuit 18, and supplies to the duty control circuit 14 an output signal used to achieve duty control in a succeeding cycle.

In the ignition device of this type, when engine failure occurs, the switching circuit 8 may happen to be kept on by the output signal of the driver circuit 16 while the device is rendered inoperative. As a result, a steady-state current flows through the primary winding 6-1 and the transistor switching circuit 8, damaging them due to heat. In order to solve this problem, a circuit may be incorporated in the device in which, after the switching circuit 8 is kept on for a certain period of time, the additional circuit turns off the switching circuit 8. However, when the transistor switching circuit 8 is abruptly turned off, a large current flows through the winding 6-2 and the ignition plug 12 is triggered, reversing the engine rotation and exhausting unburned gas.

SUMMARY OF THE INVENTION

The object of the present invention is to provide an ignition coil energizing circuit wherein when a coil current flowing for a period longer than a predetermined period is detected, this coil current is gradually reduced to zero without triggering the ignition plug.

According to one aspect of the present invention, there is provided an ignition coil biasing circuit comprising a signal generating circuit for generating an output signal having a frequency corresponding to an engine rotational speed, a switching circuit connected to an ignition coil, a current detecting circuit for detecting a current flowing through the ignition coil and for generating a signal corresponding to the detected current, a first control circuit for supplying to the switching circuit a control signal having a duty cycle corresponding to a duty cycle of an output signal from the signal generating circuit and controlling a conduction state of the switching circuit, a second control circuit for controlling a conduction state of the switching circuit in response to an output signal generated from the current detecting circuit and maintaining a current flowing through the current detecting circuit at a predetermined value while the switching circuit is being turned on by the control signal of the first control circuit, a timer for generating an output signal when the switching circuit is detected to be on over a predetermined period of time by the first control circuit, and a current supply circuit for supplying a gradually increasing current to the current detecting circuit in response to an output signal of the timer.

In the present invention, when the coil current continuously flows over a predetermined period of time, the gradually increasing current which overlaps the coil current is supplied to the current detecting circuit. Since the current flowing through the current detecting circuit is made constant by the constant current control circuit, the coil current is reduced to zero without triggering the ignition plug.

DETAILED DESCRIPTION OF THE PREFERRED EMBODIMENT

Figure 1:
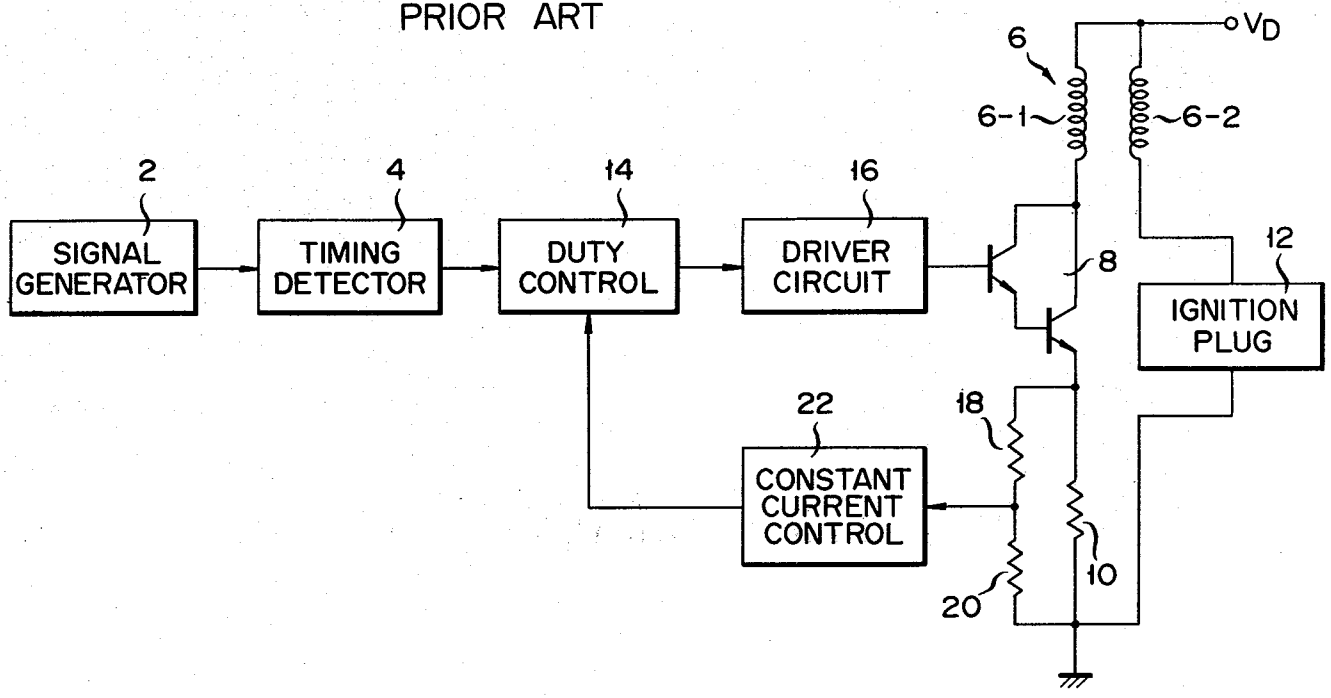
FIG. 1 PRIOR ART
FIG. 1 is a block diagram of a conventional ignition device.
Figure 2:
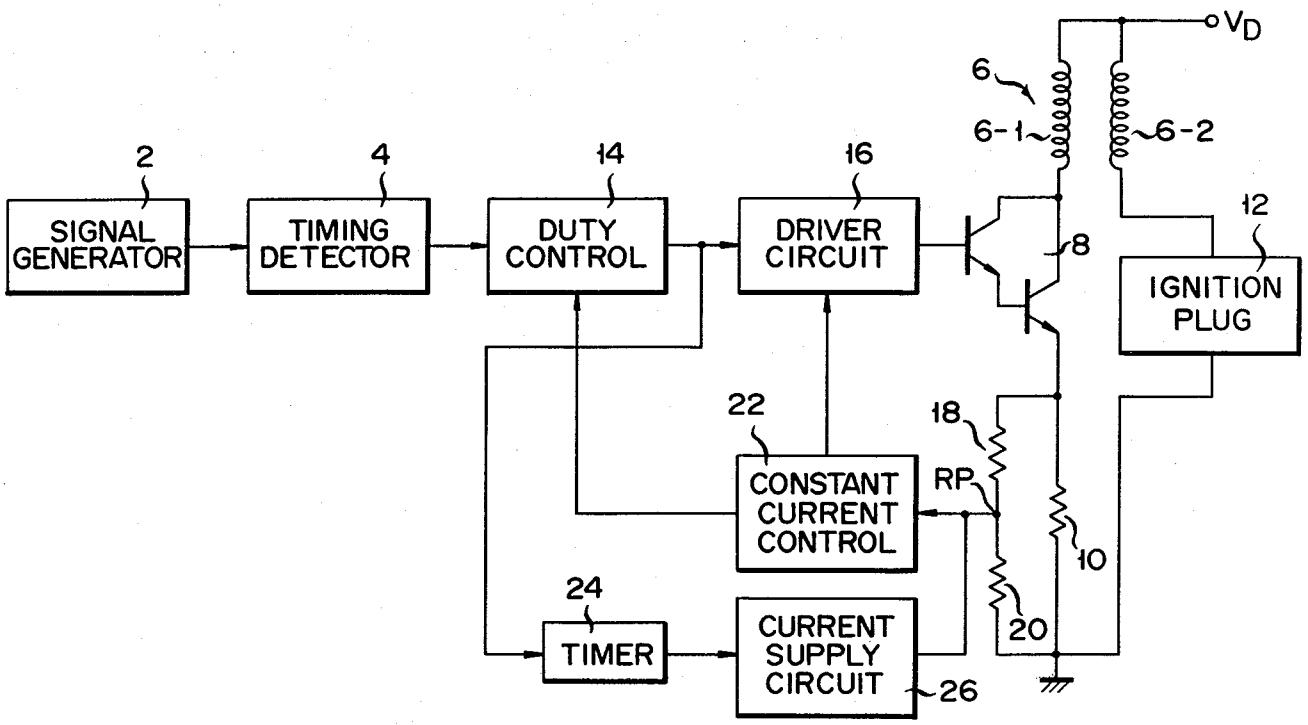
FIG. 2 is a block diagram of one embodiment of an ignition device including an ignition coil energizing circuit according to the present invention.

FIG. 2 is a block diagram of one embodiment of an ignition device including an ignition coil biasing circuit according to the present invention. The ignition device in FIG. 2 has a signal generator 2, a timing detector 4, an ignition coil 6, a transistor switching circuit 8, a resistor 10, an ignition plug 12, a duty control circuit 14, a driver circuit 16, resistors 18 and 20, and a constant current circuit 22 which are connected in the same manner as shown in FIG. 1. This ignition device further has a timer circuit 24 which is connected to an output terminal of the duty control circuit 14. The timer circuit 24 generates an output signal when a signal of high level is continuously generated for a predetermined period of time by the duty control circuit 14 and a current supply circuit 26 is connected to supply a gradually increasing current through a resistor 20 to ground in response to an output signal of the timer circuit 24.

Figure 3:
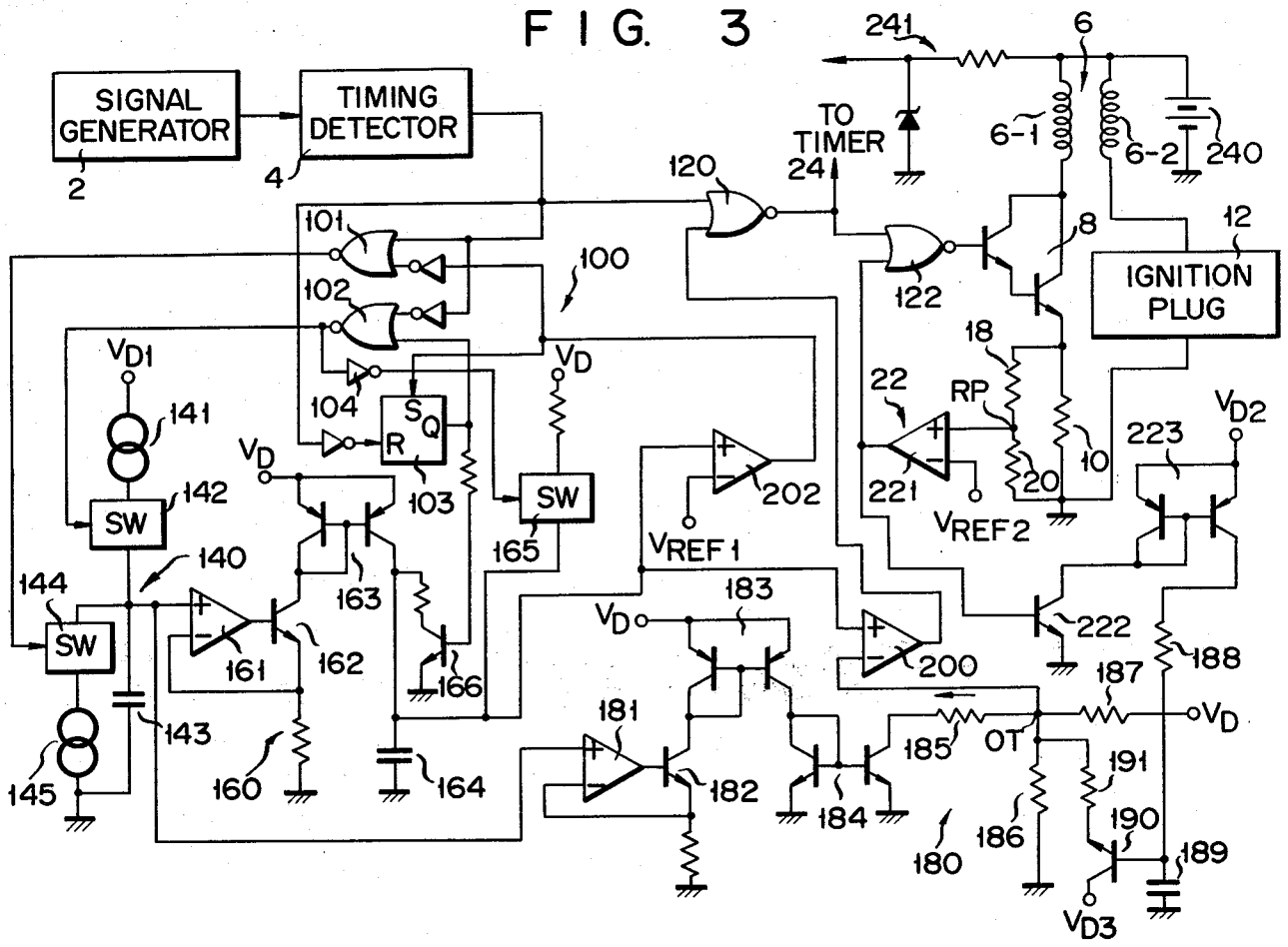
FIG. 3 is a detailed circuit diagram of part of the ignition device of FIG. 2.

FIG. 3 is a detailed circuit diagram of the duty control circuit 14, the driver circuit 16 and the constant current control circuit 22 of the ignition device shown in FIG. 2.

The duty control circuit 14 includes a control circuit 100, a NOR gate 120, a voltage storing circuit 140, a sawtooth wave generating circuit 160, a reference voltage generating circuit 180 and a comparator 200, and the driver circuit 16 includes a NOR gate 122.

An output signal is supplied from the ignition timing detector 4 to the control circuit 100 and NOR gate 120. First and second control signals from the control circuit 100 are supplied to a voltage storing circuit 140 to control the level of voltage stored in the voltage storing circuit 140. A sawtooth wave generating circuit 160 generates a sawtooth wave signal whose slope changes according to a voltage signal from the voltage storing circuit 140 and having a period determined by third and fourth control signals from the control circuit 100. An output signal from the sawtooth wave generating circuit 160 is compared by a comparator 200 with a reference voltage signal from a reference voltage generating circuit 180. When it detects that the output signal of sawtooth wave generating circuit 160 is larger than the voltage signal of reference voltage generating circuit 180, the comparator 200 supplies a logic signal "1" to the NOR gate 120. An output signal of the NOR gate 120 is supplied to the timer 24 and the NOR gate 122 which controls the conduction state of transistor switching circuit 8 while being controlled by an output signal from a control circuit 22.

The control circuit 100 includes a NOR gate 101 connected to receive an output signal directly from the timing detector 4, a NOR gate 102 connected to receive an output signal from the timing detector 4 through an inverter, a flip-flop circuit 103 of reset dominant type having a reset input terminal at which an output signal from the timing detector 4 is received via an inverter, and an inverter 104 for inverting the output signal of NOR gate 102. The other input terminal of NOR gate 102 is connected to an output terminal Q of the flip-flop circuit 103. The set input terminal of the flip-flop circuit 103 is connected to an output terminal of a comparator 202 for comparing a reference voltage $V_{REF1}$ with a sawtooth wave signal applied from the sawtooth wave generating circuit 160 and generating a high level output signal when it detects that the sawtooth wave signal is larger than the reference voltage. The other input terminal of the NOR gate 101 is connected to the output terminal of the comparator 202 through an inverter.

The voltage storing circuit 140 includes a current source 141, a switch 142 and a capacitor 143 connected in series between a power source terminal $V_{D1}$ and the ground, and a switch 144 and a current source 145 connected in series between both ends of capacitor 143. Switches 144 and 142 are controlled by first and second control signals applied through the NOR gates 101 and 102 of the control circuit 100. Voltage is charged into the capacitor 143 and this charged voltage is generated as a voltage signal in the voltage storing circuit 140.

The sawtooth wave generating circuit 160 has an amplifier 161 for receiving a voltage signal from the voltage storing circuit 140, an npn transistor 162 whose base is connected to the output terminal of amplifier 161, and a constant current source 163 whose first current path includes the collector-emitter path of the transistor 162 and whose second current path includes a capacitor 164. One end of the capacitor 164 is grounded while the other end thereof is connected to a switch 165 which is controlled by an output signal from the inverter 104 of the control circuit 100, and to a collector of an npn transistor 166 whose base is connected to an output terminal Q of the flip-flop circuit 103 and whose emitter is grounded.

The reference voltage generating circuit 180 is provided with an amplifier 181 for receiving voltage signal from the voltage storing circuit 140, an npn transistor 182 whose base is connected to the output terminal of amplifier 181, a constant current source 183 whose first current path includes the collector-emitter path of transistor 182, and a constant current source 184 whose first current path is connected in series with a second current path of the constant current source 183 and whose second current path is connected to an output terminal OT via a resistor 185. This output terminal OT is grounded via a resistor 186 and connected to a power source terminal $V_D$ via a resistor 187. The reference voltage generating circuit 180 further includes a resistor 188 and a capacitor 189 connected in series, and an npn transistor 190 whose base is connected to the junction between the resistor 188 and capacitor 189, whose collector is connected to a power source terminal $V_{D3}$, and whose emitter is connected to the output terminal OT via a resistor 191.

The control circuit 22 includes a comparator 221 for comparing a reference voltage $V_{REF2}$ with a voltage appearing at a junction RP between the resistors 18 and 20 and generating a high level output signal when the voltage at the junction RP is larger than the reference voltage, an npn transistor 222 whose base is connected to the output terminal of comparator 221, whose collector is connected to a constant current source circuit 223, and whose emitter is grounded. The constant current source 223 has a first current path grounded through the collector-emitter path of the transistor 222 and a second current path grounded through the resistor 188 and capacitor 189.

In the case of this ignition device, an output voltage of a battery 240 for supplying current energy to the ignition coil 6 is supplied through a voltage stabilizing circuit 241 as power source voltage necessary for operating the ignition circuit.

Figure 4:
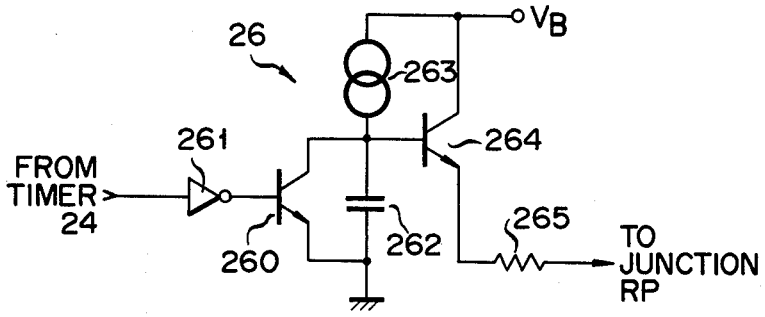
FIG. 4 is a detailed circuit diagram of a current supply circuit used for the ignition device shown in FIG. 2.

FIG. 4 is a detailed circuit diagram of the current supply circuit 26 of the ignition device shown in FIG. 2. The current supply circuit 26 comprises an npn transistor 260 the base of which is connected to the output terminal of the timer 24 through an inverter 261 and the emitter of which is grounded, a capacitor 262 connected between the emitter and the collector of the transistor 260, a constant current source 263 connected between a power source terminal $V_B$ and the collector of the transistor 260, and an npn transistor 264 the base of which is connected to the collector of the transistor 260, the collector of which is connected to the power source terminal $V_B$ and the emitter of which is connected to a junction RP of the resistors 18 and 20 through a resistor 265.

The timer 24 is reset by a signal of "1" from the NOR gate 120 and supplies a signal of high level in response to a signal of "0" from the NOR gate 120 when the period of the signal of "0" reaches a predetermined value.

The operation of ignition device shown in FIG. 3 will be described with reference to signal waveforms shown in FIGS. 5A to 5I.

Figures 5A, 5B, 5C, 5D, 5E, 5F, 5G, 5H, 5I:
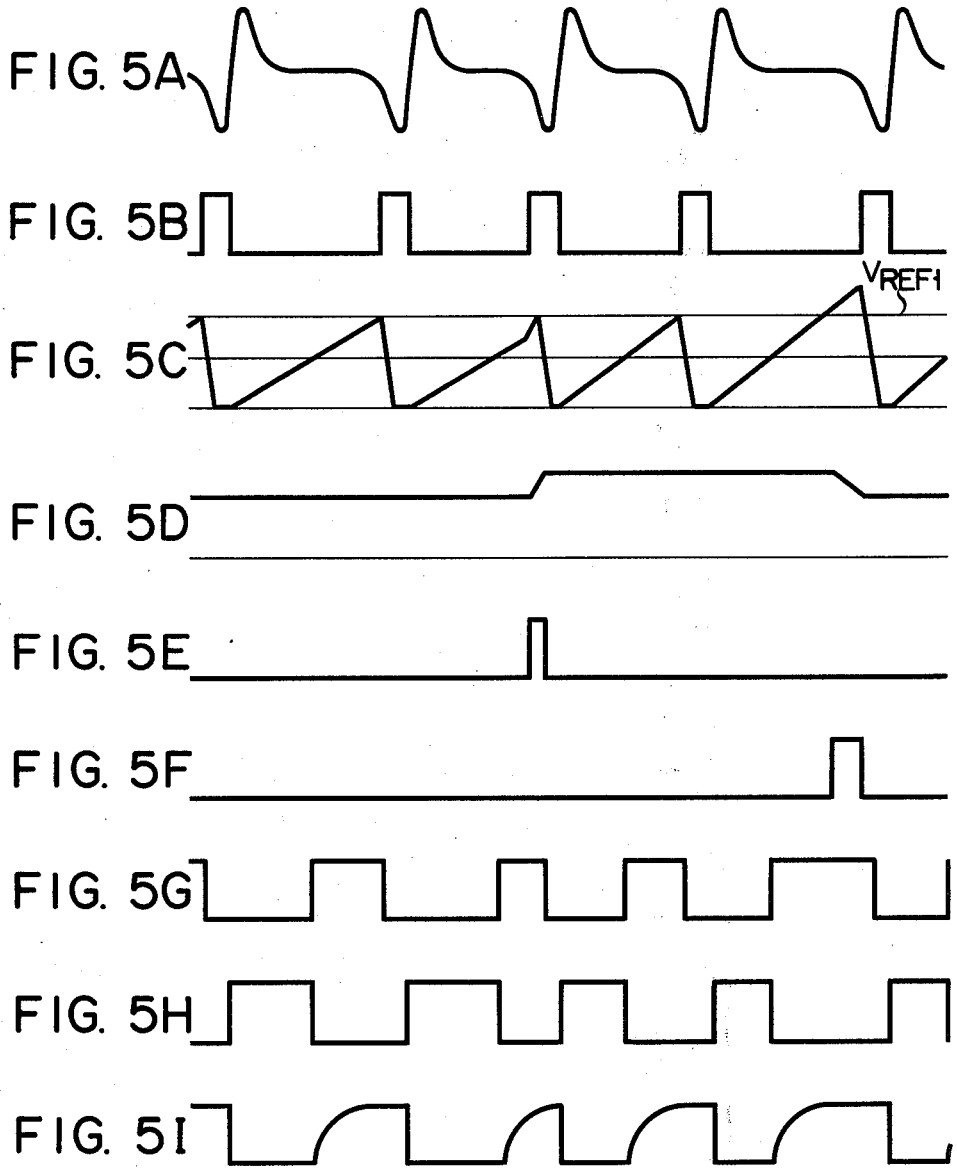
FIGS. 5A to 5I show signal waveforms for explaining the mode of operation of the circuit shown in FIG. 3.

Responsive to the rotation movement of engine shaft, an output signal corresponding to the rotation speed or rotation angle of engine shaft is generated from the signal generator 2, as shown in FIG. 5A. Responsive to an output signal of the signal generator 2, the timing detector 4 generates a pulse signal which rises when the output signal reaches a predetermined level and falls when the output signal becomes zero in level, as shown in FIG. 5B. When the output signal of timing detector 4 becomes low in level, the flip-flop circuit 103 is reset to generate a low level output signal through the output terminal Q thereof. Since a low level output signal is generated from the comparator 202 at this time, both of the NOR gates 101 and 102 generates signals "0" to thereby leave both of switches 142 and 144 open. Therefore, the amplifier 161 biases the transistor 162 with a bias voltage corresponding to the charged voltage of the capacitor 143, whereby current corresponding to this bias voltage flows through the collector-emitter path of transistor 162 causing the charging current to flow into the capacitor 164. Namely, the capacitor 164 is charged at a rate corresponding to the charged voltage of capacitor 143, as shown in FIG. 5C. When the output signal of the timing detector 4 rises at the same time when the charged voltage of the capacitor 164 reaches the reference voltage $V_{REF1}$, the flip-flop circuit 103 is set to generate a high level output signal from the output terminal Q thereof, whereby the transistor 166 is rendered conductive to discharge the capacitor 164 to zero level.

When the output signal of the timing detector 4 rises before the charged voltage of the capacitor 164 reaches the reference voltage $V_{REF1}$ with the engine being accelerated, a signal "1" is generated from the NOR gate 102 to close switches 142 and 165 for such a period as shown in FIG. 5E and to charge capacitors 143 and 164 as shown in FIGS. 5D and 5C. When the charged voltage of capacitor 164 thus comes to the reference voltage, a high level output signal is generated from the comparator 202 to set the flip-flop circuit 103, whereby a signal "0" is generated from the NOR gate 102 and the transistor 164 is rendered conductive, causing the capacitor 164 to be discharged to zero level.

Since a higher voltage is now charged in the capacitor 143, a sawtooth wave signal which rises at a sharper slope is generated from the sawtooth wave generating circuit 160 in a successive cycle and this sawtooth wave signal is controlled so as to reach the reference voltage $V_{REF1}$ when the output pulse of timing detector 4 rises.

Where the charged voltage of capacitor 164 comes to the reference voltage $V_{REF1}$ before the output signal of timing detector 4 rises with the engine reduced in speed, for example, a high level output signal is generated from the comparator 202 and a signal "1" is generated from the NOR gate 101 to close the switch 144 for a period shown in FIG. 5F, whereby the capacitor 143 is discharged a little as shown in FIG. 5D to thereby lower the charged voltage thereof a little. On the other hand, a high level signal is generated from the comparator 202 but a reset signal is supplied to the flip-flop circuit 103 so that the flip-flop circuit 103 is kept reset. When the output signal of the timing detector 4 rises thereafter, the flip-flop circuit 103 is set to render the transistor 166 conductive and to discharge the capacitor 166 to zero level.

When the output signal of the timing detector 4 falls, the capacitor 166 is charged at a rate responsive to the charged voltage of capacitor 143 and a sawtooth wave signal component is generated from the sawtooth wave signal generating circuit 160 in the same way as described above. Namely, a sawtooth wave signal having a slope corresponding to the charged voltage of the capacitor 143 and synchronized with the pulse signal of the timing detector 4 is obtained.

The comparator 200 compares a reference voltage of reference voltage generating circuit 180 with a charged voltage of the capacitor 164 and generates an output signal as shown in FIG. 5G. Therefore, an output signal shown in FIG. 5H is generated from the NOR gate 121. The low level signal of this NOR gate 121 is supplied through the NOR gate 122 to the transistor circuit 8 to render the circuit 8 conductive. Therefore, current shown in FIG. 5I flows through the primary winding 6-1, transistor circuit 8 and resistor 10. When this current becomes larger than the predetermined value and a voltage appearing at the junction between resistors 18 and 20 becomes larger than the reference voltage $V_{REF2}$, the comparator 221 generates a high level output signal, whereby a low level signal is generated from the NOR gate 122 to make the transistor circuit 8 non-conductive, interrupting the current flowing through the primary winding 6-1. As a result, the comparator 221 produces a low level signal, causing a high level output signal to be produced from the NOR gate 122. Thus, substantially a constant current will flow through the primary winding 6-1. The constant current may continuously flow through the primary winding 6-1 until an output signal from the timing detector 4 changes from the high to low level. The low level output signal from the timing detector 4 causes current flowing to the primary winding 6-1 to be interrupted rapidly, inducing an extremely high voltage in the secondary winding 6-2 to trigger the ignition plug 12.

The reference voltage generating circuit 180 controls the duty cycle of output signal applied from the NOR gate 121 by adjusting the level of reference voltage supplied to the inverted input terminal of comparator 200 according to the charged voltage in the capacitor 143, power source voltage $V_D$ and the time for which the transistor circuit 8 is made conductive. When the power source voltage $V_D$ rises, for example, potential at the output terminal OT also rises causing the reference voltage applied to the comparator 200 to be risen. When the charged voltage of the capacitor 143 rises, an increased amount of current flows through the collector-emitter path of the transistor 182 and therefore, an increased amount of current also flows to the constant current circuit 184, whereby current flows through the resistor 185 in the direction shown by an arrow, thus causing potential at the output terminal OT to be lowered. Namely, when sawtooth wave of high frequency is generated, the duty ratio of output signal of NOR gate 120 is controlled so as to have a larger value.

When the time period during which the transistor circuit 8 is made conductive becomes longer, that is, when the time period during which the high level signal is generated from the comparator 221 becomes longer, the time period during which the transistor 222 is rendered conductive also becomes longer and the capacitor 189 is charged to a higher voltage, whereby an increased amount of current flows through the collector-emitter path of transistor 190, causing potential at the output terminal OT to be risen. Therefore, the reference voltage supplied to the comparator 200 becomes higher and the duty ratio of output signal of NOR gate 120 becomes small.

Figure 6A:
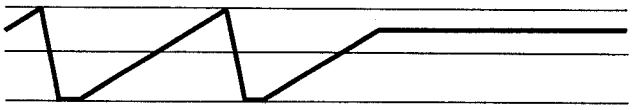
FIGS. 6A to 6E show signal waveforms for explaining the function of the current supply circuit shown in FIG. 4.
Figure 6B:
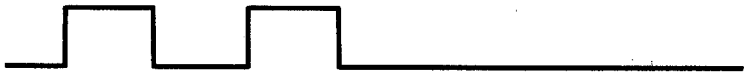
Figure 6C:
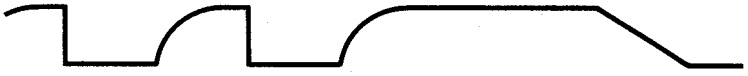

Assume that engine failure occurs when the charged voltage of the capacitor 164 is higher than the voltage at the output terminal OT and is lower than the reference voltage $V_{REF1}$. A signal of low level is generated from the comparator 202 and therefore the capacitor 164 is not discharged. The charged voltage of the capacitor 164 is kept at the constant level as shown by the level of the waveform in FIG. 6A. A high level signal is continuously generated from the comparator 200 and a signal of "0" level is generated from the NOR gate 120 as shown in FIG. 6B. The transistor switching circuit 8 is thus rendered conductive and the constant current flows into the primary winding 6-1 as shown in FIG. 6C.

Figure 6D:
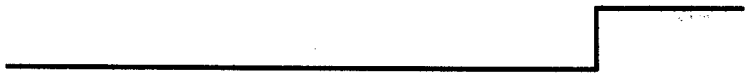
Figure 6E:
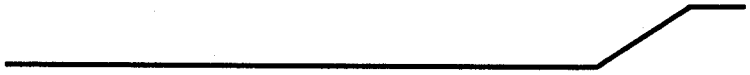

When detecting that the output signal from the NOR gate 120 is kept at a low level over a predetermined period of time, the timer 24 generates a signal of high level as shown in FIG. 6D. The output signal of high level from the timer 24 is inverted by an inverter 261 and supplied to the base of a transistor 260 which is in turn rendered nonconductive. The current from the constant current source 263 flows to the capacitor 262 which is gradually charged. As a result, the base voltage of the transistor 264 gradually increases, and the conduction resistance of the transistor 264 is gradually reduced. A gradually increasing current flows to ground through the collector-emitter path of the transistor 264, and the resistors 265 and 20, as shown in FIG. 6E. This current is combined with the current flowing through the primary winding 6-1, thus increasing the potential at the junction RP. As described above, when the potential at the junction RP increases, the duration for which the voltage of high level from the comparator 221 is generated is made long and the duration for which the transistor switching circuit 8 is turned off is prolonged. As a result, the coil current, the waveform of which is shown in FIG. 6C, gradually decreases as opposed to the increase in the current flowing from the current supply circuit 26. When the current flowing from the current supply circuit 26 reaches the predetermined level, the comparator 221 produces a signal of high level without any cooperation of the coil current. The coil current is thus cut off. In this way, since the coil current flowing through the primary winding 6-1 gradually decreases to zero, a large voltage is not induced at the secondary winding 6-2 when the coil current is cut off. Therefore, the ignition plug 12 may not be triggered.

Figure 7:
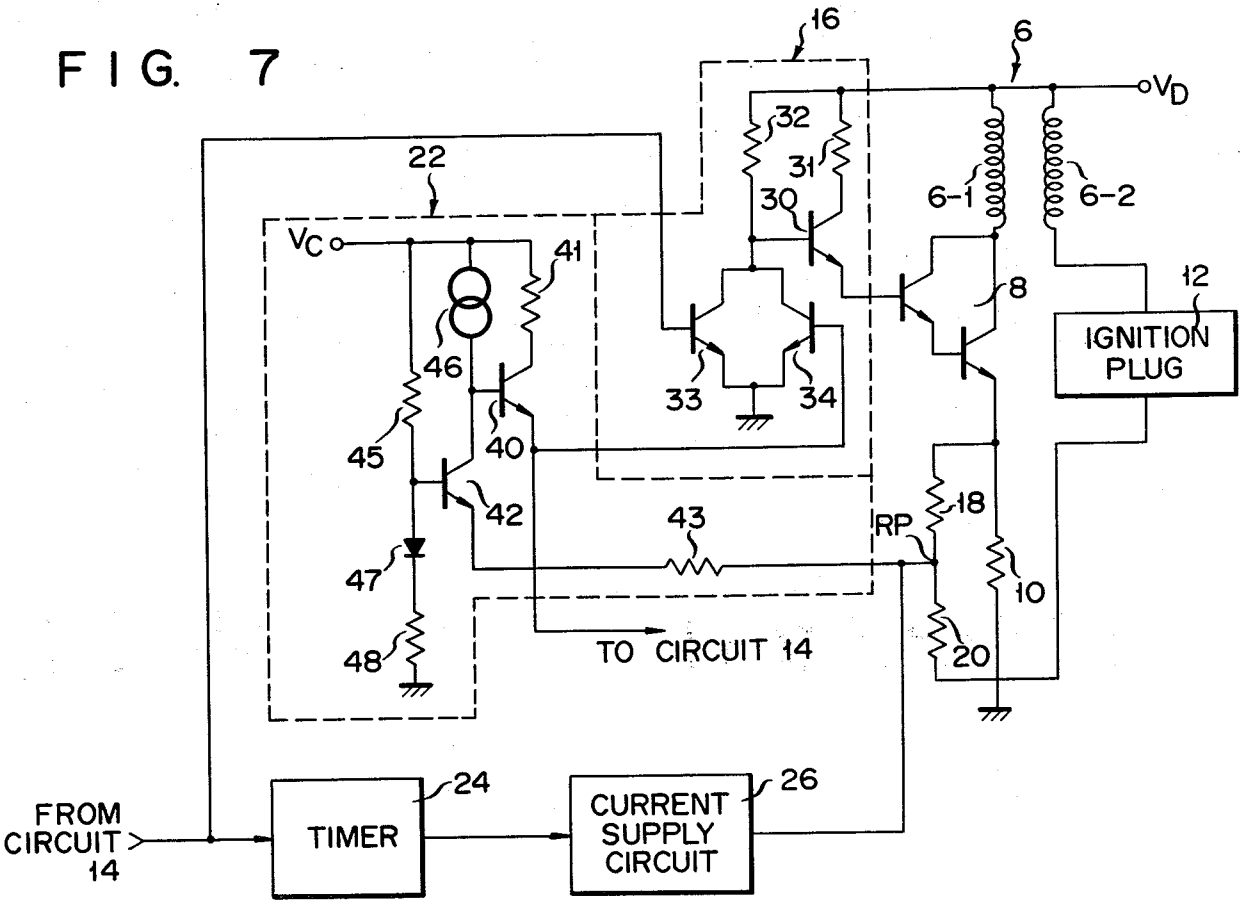
FIG. 7 is a circuit diagram of part of a modification of the ignition coil energizing circuit shown in FIGS. 2 to 4.

FIG. 7 is a circuit diagram of a modification of the driver circuit 16 and the constant current control circuit 22. The driver circuit 16 has an npn transistor 30 whose collector and base are respectively connected to the power source terminal $V_D$ through resistors 31 and 32 and whose emitter is connected to the base of the transistor of the switching circuit 8, and npn transistors 33 and 34 whose collectors are connected to the base of the transistor 30 and whose emitters are grounded. The collector of the transistor 33 is connected to the output terminal of the duty control circuit 14.

The constant current circuit 22 has an npn transistor 40 whose collector is connected to the power source terminal $V_C$ through a resistor 41 and whose emitter is connected to the base of the transistor 34 and the duty control 14, an npn transistor 42 whose emitter is connected to the junction of the resistors 18 and 20 through a resistor 43 and whose base is connected to the power source terminal $V_C$ through a resistor 45, a constant current source 46 connected between the power source terminal $V_C$ and the collector of the transistor 42, and a diode 47 and a resistor 48 which are connected in series between ground and the base of the transistor 42.

In the circuit shown in FIG. 7, when the current flowing through the primary winding 6-1 becomes greater than the predetermined value and when the potential at the junction RP of the resistors 18 and 20 becomes higher than the voltage drop across the resistor 48, the transistor 42 is rendered nonconductive. The current flows from the constant current source 46 to the base of the transistor 40 and the transistor 40 is rendered conductive. As a result, the voltage of the power source terminal $V_C$ is applied to the base of the transistor 34 through the resistor 41 and the collector-emitter path of the transistor 40 to turn on the transistor 34. The transistor 30 is therefore rendered nonconductive and the transistor switching circuit 8 is turned off, decreasing the coil current. By this decrease, the potential at the junction of the resistors 18 and 20 falls below the predetermined value and the transistor 42 begins to be conductive. The base current of the transistor 40 thus decreases and the transistor 40 begins to be nonconductive. As a result, the transistor 34 is rendered nonconductive. In this case, if the transistor 33 is kept nonconductive in response to an output signal from the duty control circuit 14, the transistor 30 is rendered conductive and the switching circuit 8 is turned on, increasing the coil current flowing through the primary winding 6-1. The coil current is substantially kept constant.

Assume that engine failure occurs at a certain timing, a signal of low level is generated from the duty control 14, and the transistor 33 remains nonconductive as described before. A constant coil current flows through the primary winding 6-1. When the timer 24 detects that the output signal from the duty control circuit 14 is kept at a low level over a predetermined period of time, the timer 24 generates an output signal of high level. The current supply circuit 26 sends an output signal of high level. The gradually increasing current from current supply circuit 26 flows to ground through the resistor 20, as shown in FIG. 6E in response to the output signal of high level from the timer 24. The potential at the junction RP of the resistors 18 and 20 thus increases and the transistor 42 gradually begins to be turned off. The transistors 40 and 34 also begin to be conductive gradually while the transistor 30 and the switching circuit 8 begin to be nonconductive gradually. As a result, the coil current gradually decreases to zero as shown in FIG. 6C. Even in this case, when the coil current is cut off, the current is not induced in the secondary winding 6-2, thus preventing triggering the ignition plug 12.

What we claim is:

1. An ignition coil energizing circuit comprising:

a signal generating circuit for generating an output signal having a frequency corresponding to an engine rotational speed;

a switching circuit connected to an ignition coil;

a current detecting circuit having a resistive means connected in series to said switching circuit, for producing an output signal corresponding to a voltage drop across said resistive means;

a first control circuit for supplying to said switching circuit a control signal having a duty cycle corresponding to a duty cycle of an output signal from said signal generating circuit and controlling a conduction state of said switching circuit;

a second control circuit for controlling a conduction state of said switching circuit in response to an output signal generated from said current detecting circuit and maintaining a current flowing through said current detecting circuit at a predetermined value while said switching circuit is being turned on by the control signal of said first control circuit;

a timer for generating an output signal responsive to said switching circuit being kept on for more than a predetermined period of time by said first control circuit; and a current supply circuit for supplying a gradually increasing current to said resistive means in response to an output signal of said timer.

2. An ignition coil energizing circuit according to claim 1, wherein said timer supplies an output signal to said current supply circuit in response to a turn-on output signal from said first control circuit turning on said switching circuit when detecting that the turn-on output signal is kept generated for a predetermined period of time.

* * * * *